US009532913B1

(12) United States Patent
Jacks

(10) Patent No.: US 9,532,913 B1
(45) Date of Patent: Jan. 3, 2017

(54) PARTIAL-LEG SUPPORT FOR AMPUTEES

(71) Applicant: Richard A. Jacks, Hammond, LA (US)

(72) Inventor: Richard A. Jacks, Hammond, LA (US)

( * ) Notice: Subject to any disclaimer, the term of this patent is extended or adjusted under 35 U.S.C. 154(b) by 0 days.

(21) Appl. No.: 14/824,612

(22) Filed: Aug. 12, 2015

(51) Int. Cl.
*A61G 5/12* (2006.01)
*A47C 7/50* (2006.01)

(52) U.S. Cl.
CPC ..... *A61G 5/12* (2013.01); *A47C 7/503* (2013.01); *A47C 7/506* (2013.01); *A61G 2005/127* (2013.01)

(58) Field of Classification Search
CPC ... A47C 7/506; A47C 7/503; A61G 2005/127; A61G 5/12; A61G 5/1056
USPC ..... 297/423.3, 423.39, 423.4
See application file for complete search history.

(56) References Cited

U.S. PATENT DOCUMENTS 439,088 A 10/1890 Allen
799,702 A * 9/1905 Barlow ..... A47C 7/503 297/402
2,383,340 A * 8/1945 Pezzano ..... A47B 83/04 280/43.16
2,826,242 A 3/1958 Thompson
3,861,745 A 1/1975 Forrest
4,572,577 A 2/1986 LaRue
4,712,836 A 12/1987 Gerber
5,098,158 A * 3/1992 Palarski ..... A47C 1/022 297/234
5,145,197 A 9/1992 Gatti
5,306,074 A 4/1994 Mocur
5,449,221 A * 9/1995 Stander ..... A47C 16/02 297/423.1
5,906,415 A * 5/1999 Mocur ..... A61G 5/12 297/423.3
2005/0151408 A1* 7/2005 Pratte ..... A47C 16/025 297/423.39
2006/0071531 A1 4/2006 Groth
2006/0138846 A1* 6/2006 Frey ..... B64D 11/06 297/423.3

* cited by examiner

*Primary Examiner* — Milton Nelson, Jr.
(74) *Attorney, Agent, or Firm* — Keaty Law Firm, LLC

(57) ABSTRACT

A partial-leg support and method for comfortable, adjustable, cleanable, and portable support for the leg stump or stumps remaining after partial amputation of the leg or legs while seated.

20 Claims, 7 Drawing Sheets

PARTIAL-LEG SUPPORT FOR AMPUTEES

BACKGROUND OF THE INVENTION

This invention provides a partial-leg support and method for comfortable, adjustable, cleanable, and portable support for the leg stump or stumps remaining after partial amputation of the leg or legs while seated.

This invention is my solution to problems encountered in caring for a family member who lost most of both legs. Although the problems occur in several sitting situations inside the home or outside the home, all aspects of the problems can be better understood in terms of wheelchairs provided by healthcare facilities, airlines, etc. Such standard wheelchairs have adjustable footrests for the purposes of preventing the person's feet from dragging on the ground and to balance the person and prevent falling forward out of the wheelchair. While a person sits in a wheelchair for a long time, that person's discomfort is lessened by not only the better balance, but also by support provided by the feet on the footrests or on the floor, which prevents the thighs or upper legs from dangling unsupported and uncomfortably from the front edge of the sitting surface, and allows shifting and changing of position for greater comfort. A leg or partial-leg amputee cannot make use of the wheelchair's footrests. Although an amputee might have devised a safer and more comfortable sitting arrangement at home, outside the home the amputee is subject to the disadvantages of standard wheelchairs, chairs, benches, vehicle seats, and other sitting surfaces.

Standard seating not only accommodates peoples' legs, it assumes the legs are there for balance and for shifting of position. The pressures resulting from sitting can be redistributed with a push of the legs, and can be relieved by standing, but both of those solutions require contact with, and pushing against, a floor or footrest. Although a partial-leg amputee might be able to use the stump for pushing, there is nothing to push against in standard seating.

In standard seating, the effective weight bearing on a person's upper legs, hips, and buttocks is reduced in part by the person's lower legs and feet in contact with the floor or footrest. Such support reduces the pressure and discomfort of having the torso's weight focused on the seat area. Where a part of a leg extends from the front edge of a seat, but does not rest upon a floor or footrest, then the weight of that partial leg is added to the torso's weight and is focused on the seat area, particularly at the front edge of the seat, which acts like the fulcrum of a lever.

Although a purpose-made chair for partial-leg amputees can be devised, the benefits are only realized when the person is seated in that particular chair, not when the person has to sit in other seating. Seating outside the home or office cannot normally be permanently modified, and such modification would be time consuming and costly for occasional or one-time use.

A permanent, fixed extension to support a part of a leg would not be desirable because the ability to shift between applying and removing and increasing and decreasing support on a partial leg, and therefore on the hips and buttocks, is needed for maximum comfort, and a fixed extension would interfere with an amputee's getting into and out of a chair or wheelchair, and would interfere with any use of a chair or wheelchair by non-amputees.

None of the existing systems or methods of seating for leg amputees address the problem of quickly and possibly temporarily adapting the existing, standard seating that leg amputees must make use of.

Items used in a healthcare setting need to be easily cleaned or sterilized, or need to be disposable—especially items used in the seat of a wheelchair. Anything used for support of partial legs needs to be easily and thoroughly cleaned on a regular basis. In a healthcare setting, cushions or pads used for comfort are generally separate items from the underlying structure or equipment, so that they can be changed and washed separately.

Various patents teach the use of footrest for a wheelchair to support a stump of a leg. Some of the leg supports are hingedly connected to the front ends of the wheelchairs, while others are foldable, telescopically extendable, or retractable into the chair frame. Some patents teach the use of springs in the hinge locking mechanisms.

U.S. Pat. No. 439,088 issued on Oct. 28, 1890 to Horace R. Allen for "Operating-Chair" discloses improvements to adjustable chairs for the use of surgeons, dentists, oculists, and generally those having operations to perform upon the human body. The leg portion of the operating-chair has a depression in the upper face of its lower part. The chair includes a pivoted and vertically-movable foot-rest capable of being folded back into the depression when not in use to leave the upper surfaces even.

U.S. Pat. No. 2,826,242 issued on Mar. 11, 1958 to Herman M. Thompson for "Leg Support for Invalids' Folding Chair" discloses an invalids' chair, particularly of the foldable wheeled type. The chair has a leg support for ready attachment to the chair and adapted to extend outwardly from the chair when the chair is in use and to be folded with the chair and swing into position to prevent accidental opening thereof. The leg support is adapted for normal extension forwardly of the chair. The leg support comprises clamping means for engagement on one of said front uprights, a U-shaped cradle having its legs spaced apart a greater distance than the width of the chair over said sides when folded, and a transverse plate member slidably disposed on the cradle. The cradle is pivotally mounted on the clamping means for vertical swing-able movement with respect to the chair whereby when the chair is in folded position, the cradle may be upwardly swung for presenting its legs at opposite sides of the folded wheeled sides to prevent accidental unfolding of the chair, and with the plate member abutting on one margin against the rear uprights and on another margin against the arms.

U.S. Pat. No. 3,861,745 issued on Jan. 21, 1975 to Edward J. Forrest for "Portable and Collapsible Seat and Leg Board for Leg Amputees" discloses a portable and collapsible seat comprised of hinged boards used by patients with an amputated leg to support their remaining stump in a horizontal position when they are in a sitting position in a chair and provided with an easy releasable hinge to drip the hinged board when the patient wishes to rise to an upright position. The leg rest has two flat board-like members connected by a hinge and aligned in horizontal relationship to provide a seat portion pivotally connected to an extended leg stump supporting portion a two armed pivotally connected hinge. A lower arm is connected to the underside of the first seat board and an upper arm is connected to the underside of the extended leg stump supporting section to support the extended board when in an aligned relationship. The leg support also has a pivotally supported releasing element bearing against the under surface of the upper arm of the pivotally connected hinge, the releasing element forcing the two arms outward when depressed to break their straight line supporting position. The supporting hinge is comprised of two arms one shorter than the other and both mounted on either side of a pivotal pin. The hinge is movable either side of an aligned relationship. The hinge arms are mounted with one end pivotally affixed adjacent the leg portion of the board and the other end pivotally affixed to a bracket spaced from the seat portion of the board. The hinge also has a pivotally supported releasing element positioned under the leg portion and a slot cut into the longer arm of said hinge so that when one arm of the hinge attached adjacent the seat portion of the board breaks inward toward the board, the slot in the hinge arm will grip the pivotally supported releasing element and stop further movement of the hinge.

U.S. Pat. No. 4,572,577 issued on Feb. 25, 1986 to Adrian J. LaRue for "Portable Seat Having Slidable Leg-Supporting Sections for Leg Amputees" discloses a portable seat for disposition in a chair that comprises a seat section on which a leg amputee sits and slidable leg-supporting sections on which a residual limb is supported when the leg-supporting section is moved from a nonleg-supporting position within the seat section to a leg-supporting position in a substantially horizontal position. The leg-supporting section can be slidable within the seat section when the amputee wishes to rise to a standing position. The seat section comprises a bottom member with a cavity, in which the leg-support section is slidably disposed and a top member secured onto the bottom member. The cavity is open at a front end of the bottom member so that a front portion of the leg-supporting section extends outwardly therefrom when said leg-supporting section is in the nonleg-supporting position. Opposing side walls of the cavity adjacent the open front end thereof are provided with stop surfaces and the leg-supporting section is provided with projections that engage the stop surfaces to limit the outward movement of the leg-supporting section. The front portion of the leg-supporting section includes a groove for engagement by fingers to slide the leg-supporting section to the leg-supporting position.

U.S. Pat. No. 4,712,836 issued on Dec. 15, 1987 to James R. Gerber for "Leg Rest for Below Knee Amputee" discloses an improved swing away stump rest for below the knee (BK) amputees to maintain comfort and proper positioning of the stump to assist in preventing knee flexion contracture of the amputated limb and edema in the stump. The swing away feature provides for maximum safety and convenience when transferring. The stump rest has a panel, a vertical tube that cab secured to the wheel chair, a horizontal tube permanently attached to the vertical tube at or near the top thereof. The horizontal tube has at least one longitudinal ridge extending substantially the length thereof and one longitudinal ridge extending substantially the upper length thereof. A cylindrical sleeve is slidably mounted on the horizontal tube. A transverse channel is formed at the top of the sleeve; the channel communicates with the horizontal tube. The channel receives and retains a locking means for securing the sleeve to the horizontal tube. The locking means comprises a knobbed clasp bolt, flanged clasp and opposing threaded flanged clamp, said clamps mounted on said bolt and said clamps situated on a horizontal plane on opposing sides of the horizontal tube and the upper ridge. The said sleeve also has attachment means situated thereon for securing the sleeve to the stump rest panel. The stump rest panel is padded.

U.S. Pat. No. 5,145,197 issued on Sep. 8, 1992 to Contemporary Medical Equipment Corp. for "Folding Wheelchair with Rigid Seat" discloses a folding wheelchair with a rigid seat, leg support members stored in a compartment within the seat, a rigid backrest that can be collapsed when the wheelchair is folded, armrests that can be swing toward the seat or the backrest, and wheels that can be adjusted to raise or lower the seat and/or to shorten or lengthen the wheelbase. The rigid seat can be raised to a position in which the front or the front and rear portions are elevated. The wheelchair includes adjustable and retractable leg supports. The leg supports can be retracted when not needed and/or when the wheelchair is collapsed, thus providing a more compact package. The leg supports are telescopically adjustable over a wide range to suit legs of various lengths and the leg rests are also adjustable to place them in any desired position of elevation.

U.S. Pat. No. 5,306,074 issued on Apr. 26, 1994 to Paul Mocur for "Amputee Attachment for a Wheelchair" discloses a body support unit that is installable in a wheelchair to facilitate use of the wheelchair by a user having a leg amputated below the knee. The support unit includes a seat member and a leg support panel extending forwardly from the front edge of the member for supporting the user's amputated leg. The panel is hingedly suspended from the seat member for movement to a lowered position that allows the user to get into and out of the wheelchair without interference by the panel. The seat and panel thus form an essentially continuous support surface for the buttocks, thigh, and that portion of the leg remaining below the knee. A flexible strap-type leg restraint is mounted on the panel to immobilize the amputated leg in a horizontal position while the user is seated in the wheelchair. In a typical construction, the amputee attachment panel has a length of about eleven inches. The free end of the panel is located forwardly beyond the position of the user's kneecap. The panel effectively supports a user having a leg amputated below the knee. Also, the panel tends to prevent the user's amputated leg from curling toward the thigh due to contraction of the leg muscles (resulting from prolonged sitting in a wheelchair without adequate support). The amputee attachment panel has a width slightly less than one half the seat width. The panel supports the weight of the amputated leg, while the user's other leg and foot are supported by the conventional leg support unit. The amputee attachment panel is swung down to its lowered position to facilitate movement of the user into or out of the wheelchair. The attachment can be used for an amputee with either a right or left amputated leg, or in a pair for a bi-lateral amputee. A spring mechanism is incorporated into the hinge structure for the panel to assist the user in raising the panel. A manually-actuated latch structure holds the panel in its raised position. Preferably, the seat is rigid to hingedly suspend the panel. The seat is neither flexible nor deflectable under the user's weight. Also, the seat and panel are a self-contained unit installable on a range of conventional wheelchairs without structural modification of the wheelchair. The amputee attachment panel has two guides for mounting a flexible, strap-type leg restraint. The restraint includes a pad designed to fit over the user's kneecap, and a strap that wraps around the panel to immobilize the leg in a horizontal position. The leg restraint can be placed around or removed from the leg by the user.

U.S. Patent application Publication No. 2006/0071531 published on Apr. 6, 2006 to Michael C. Groth for "Leg Amputee Support Assembly for Use with a Wheelchair" discloses an amputee support assembly that includes a seat, a limb support and a pivot point disposed between the seat and limb support. The seat is attached to a first pivot member, a second pivot member, and a cam lock mechanism. The first pivot member and the second pivot member are adapted to rotatably engage one another when the cam lock mechanism is used. Each pivot member includes a hub portion having a circular face and a number of teeth defined within the face. The first pivot member includes a hub recess that is designed to receive a hub extension of the second pivot member. The outer periphery of the hub portion of the second pivot member also includes a lip that precludes access to the teeth that lie between the first and second pivot members. The cam lock mechanism includes a cam lock lever that is pivotally attached to a lock post, forcing the pivot members together to prevent rotation between them. The second pivot member is attached to the limb support. The cam lock mechanism includes a cam lock lever that is pivotally attached to a lock post. Rotation of the cam lock lever effects a pulling force on the lock post, which forces the first and second pivot members securely together to prevent rotation between them. In this fashion, the cam lock mechanism can be locked and unlocked to secure or allow movement between the two pivot members. When a desired position is found by the wheelchair user, the cam lock lever can be urged downwardly toward the second pivot member. This will rotate a cam portion of the cam lock lever thereby exerting a tension force on the lock bolt and urging the meshed teeth of the pivot members together and preventing movement between them. This position will be maintained until a change of position is desired or required by the wheelchair user.

There is a need for a means of partial-leg support for leg amputees that is portable and can be used with any wheelchair, chair, or other seating that an amputee encounters, and can then be removed and re-used, and that is adjustable so that support for a partial leg can be increased or decreased as needed.

SUMMARY OF THE INVENTION

The present invention provides a partial-leg support and method for comfortable, adjustable, cleanable, and portable support for the leg stump or stumps remaining after partial amputation of the leg or legs while seated.

The present invention solves existing problems of lack of such partial-leg support, lack of portability of such partial-leg support, and lack of adjustability of such partial-leg support.

BRIEF DESCRIPTION OF DRAWINGS

Reference will now be made to the drawings, wherein like parts are designated by like numerals, and wherein.

DETAILED DESCRIPTION OF THE INVENTION

Figure 1:
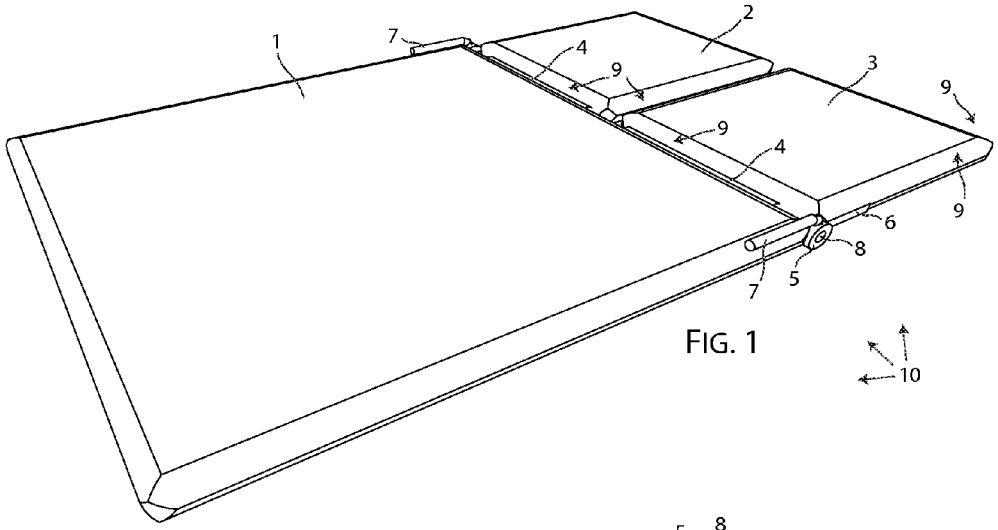
FIG. 1 is a perspective view of an embodiment of the invention.
Figure 2:
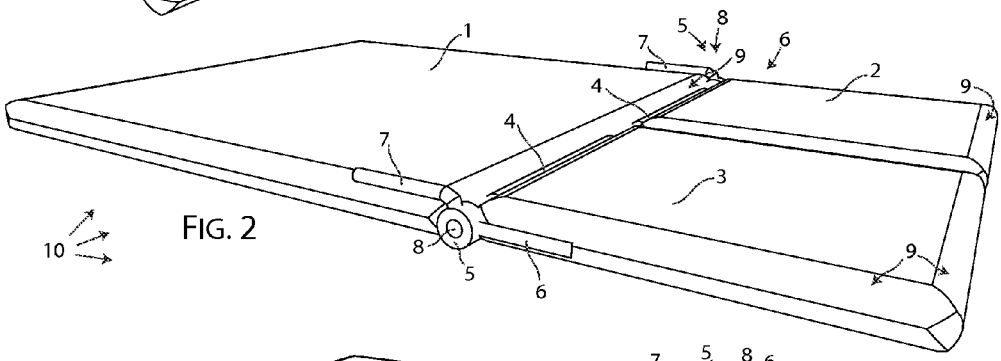
FIG. 2 is a perspective view of an embodiment of the invention.
Figure 3:
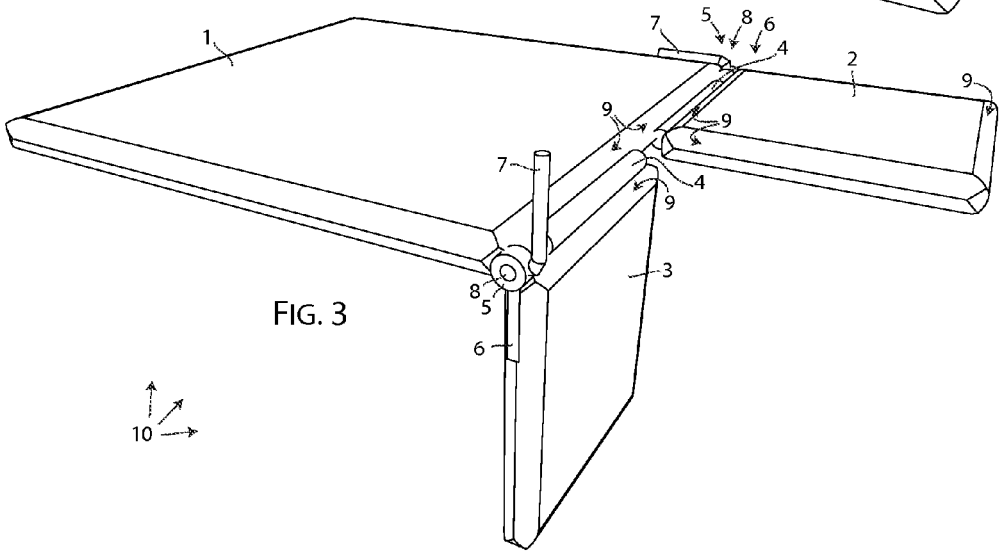
FIG. 3 is a perspective view of an embodiment of the invention in use.
Figure 4:
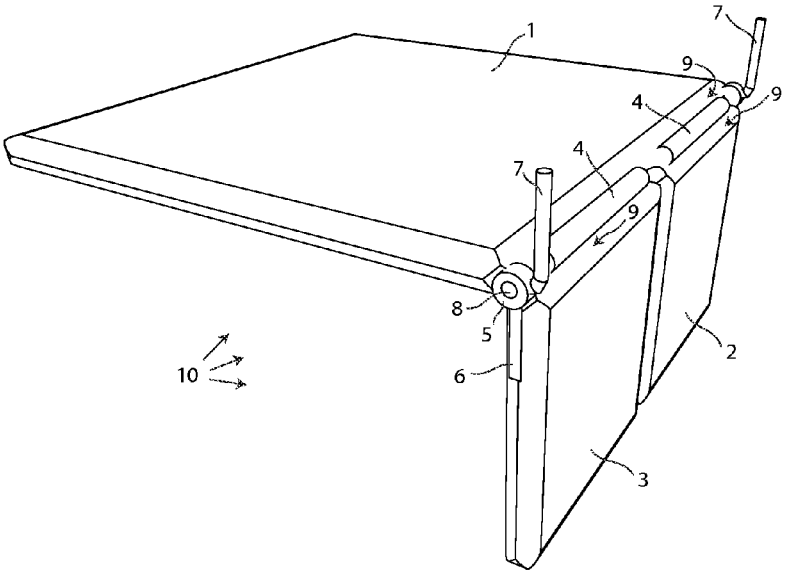
FIG. 4 is a perspective view of an embodiment of the invention in use.
Figure 5:
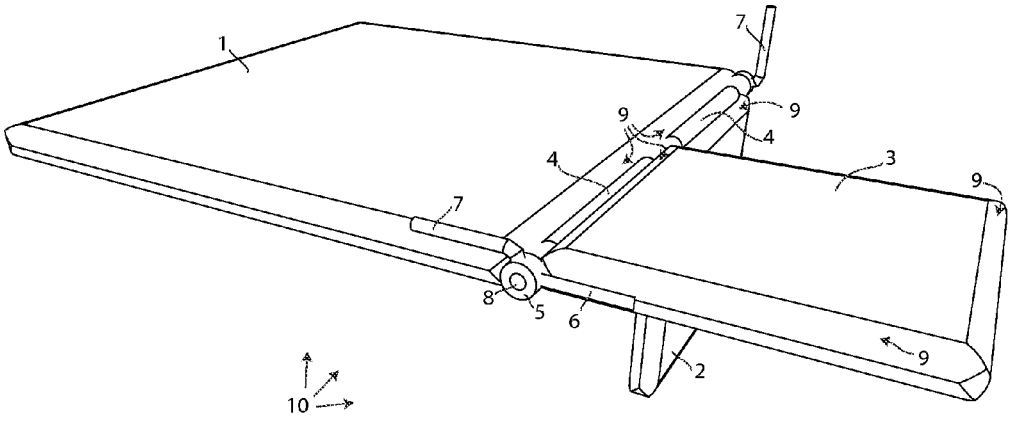
FIG. 5 is a perspective view of an embodiment of the invention in use.
Figure 6:
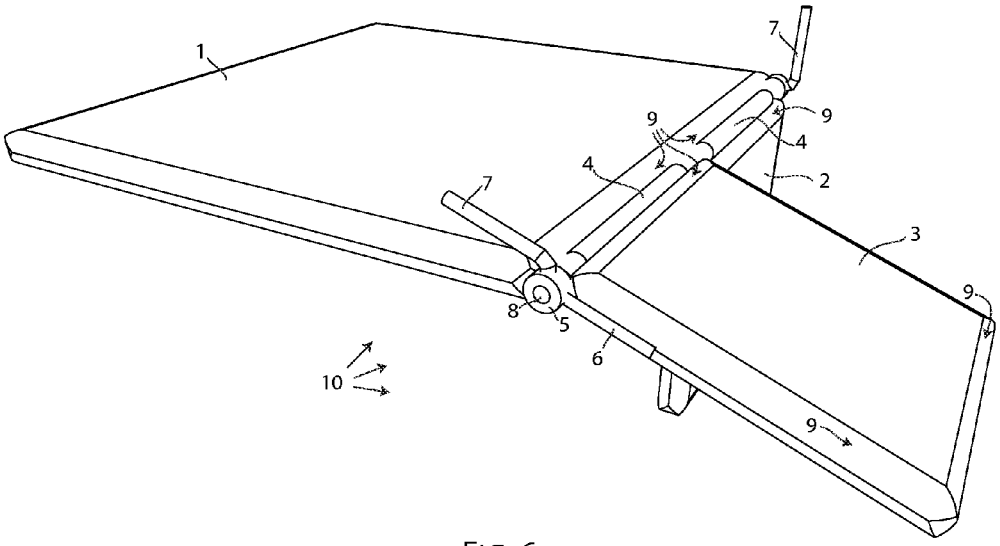
FIG. 6 is a perspective view of an embodiment of the invention in use.
Figure 7:
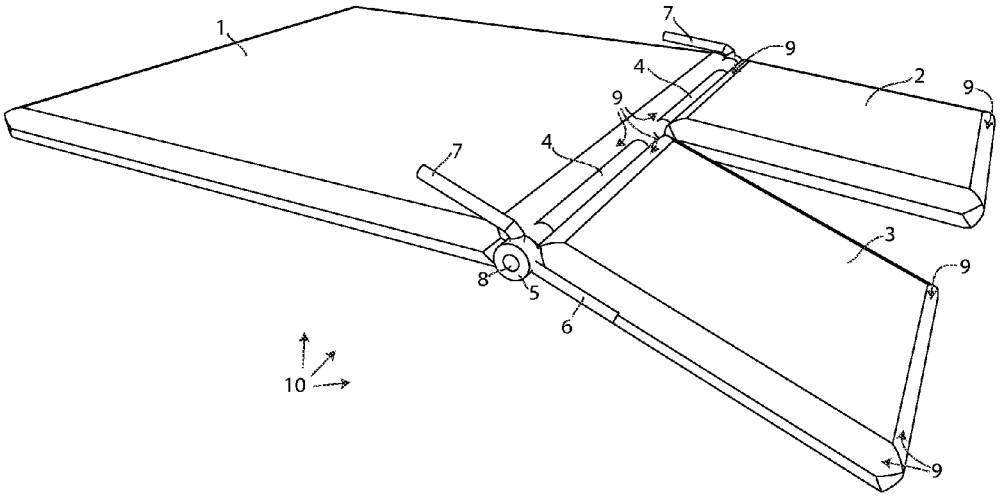
FIG. 7 is a perspective view of an embodiment of the invention in use.

Referring to FIG. 1 & FIG. 2, an embodiment of the partial-leg support 10 comprises a seat section 1, a left extension 2, a right extension 3, hinges 4 joining the back edges of the left and right extensions to the front edge of the seat section, and a lock-release 5 for each extension preventing or permitting rotation about each hinge 4, and consequently placing the top surfaces of the extensions into positions where they are essentially co-planar with the top surface of the seat section, or at an essentially right angle downward, or at an intermediate position between fully raised and fully lowered.

The partial-leg support also has fillet-round voids 9 at the top-front edge of the seat section and at the top-front and top-back edges of the left and right extensions. Those edges are rounded or bullnosed so that the edges will not pinch during rotation about the hinges, and will not present a sharp angle at the front edge of the seat section or the front edge of the left or right extensions. The other edges may optionally have such fillet-round voids for reasons of comfort, aesthetics, costs of materials, or weight.

In a preferred embodiment, the lock-release 5 is a lockable quarter-turn rotating mechanism located co-axially with the hinges 4. Optionally, the lock-release can be ratcheted. Attached to each lock-release 5 are a lock-release extension lever 6 providing leveraged force for moving and holding the left or right extensions, a lock-release handle 7 providing control of raising and lowering the extensions, and a lock-release button 8 locking or unlocking the lock-release and preventing or permitting rotation about the hinge.

Referring additionally to FIGS. 3, 4, 5, 6, & 7, the left extension 2 or right extension 3, independently, can be placed into a raised position where the top surface of the extension is essentially co-planar with the top surface of the seat section, into a lowered or dropped position where the top surface of the extension is at essentially a right angle downward, or at intermediate positions. This variable positioning allows for an optimum accommodation of different-sized and different-situated partial legs among potential users, and also allows for variation, over time, of the level of support chosen by any particular user.

Figure 8:
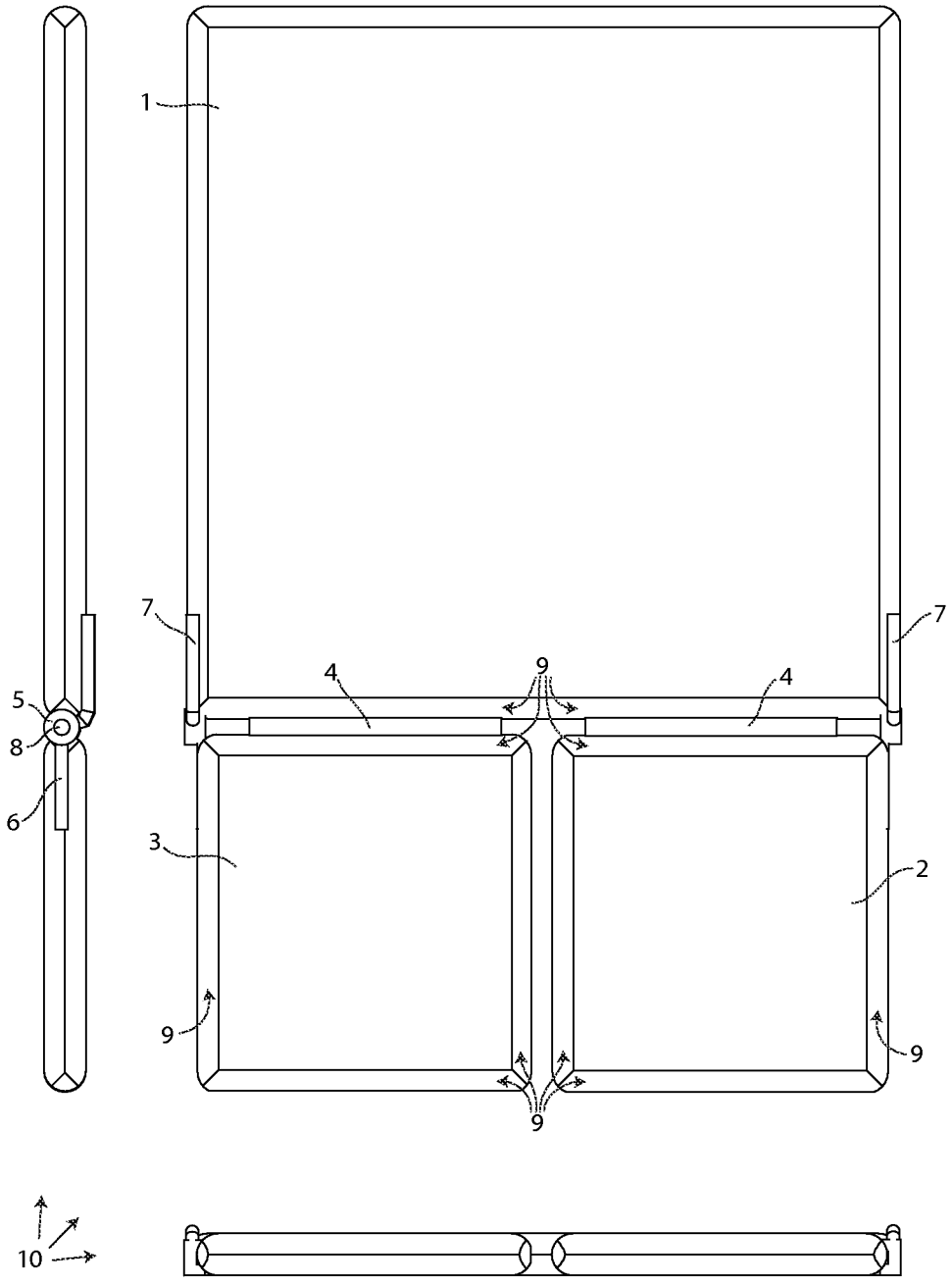
FIG. 8 is a top, side, and front view of an embodiment of the invention.
Figure 9:
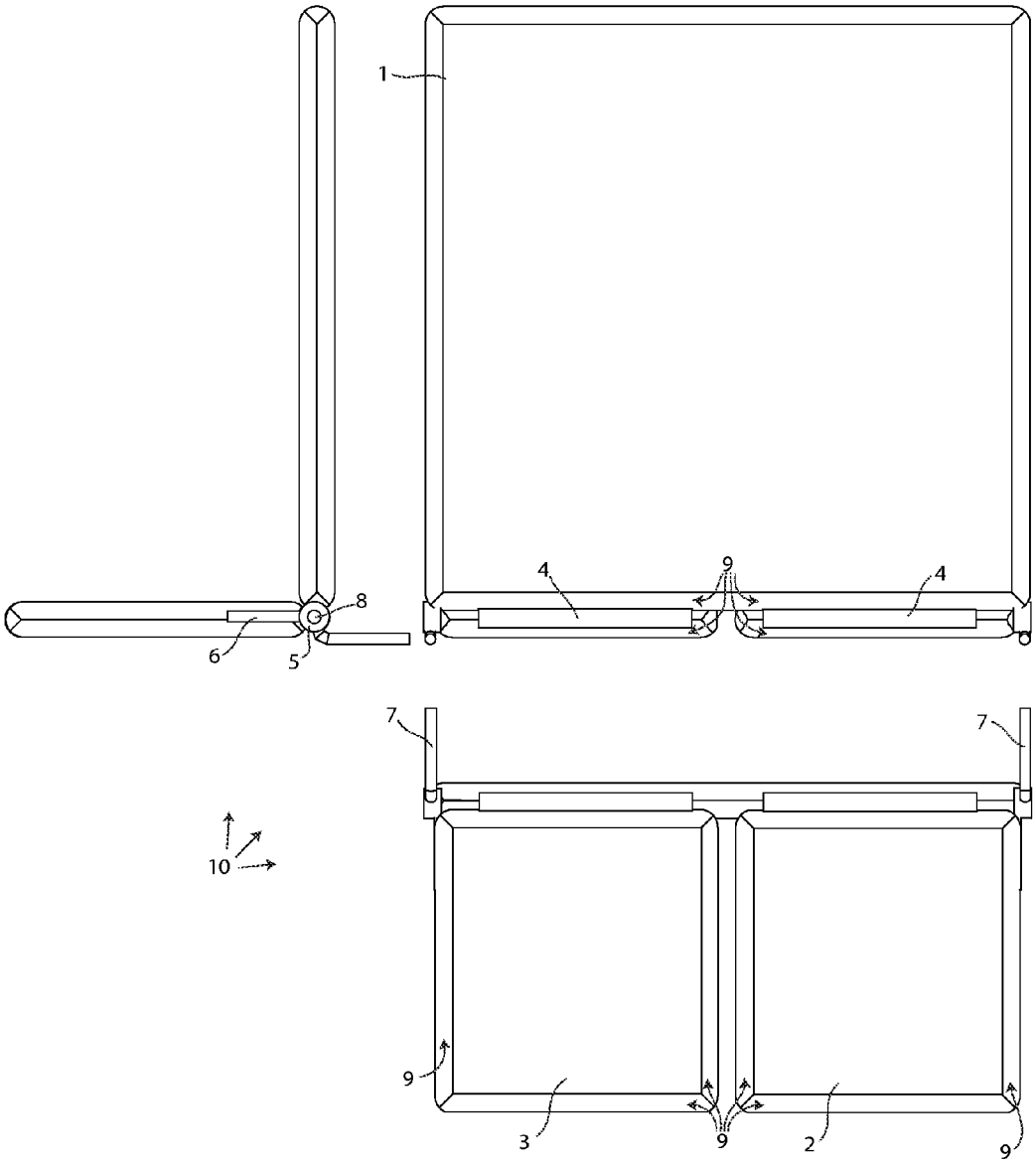
FIG. 9 is a top, side, and front view of an embodiment of the invention in use.
Figure 10:
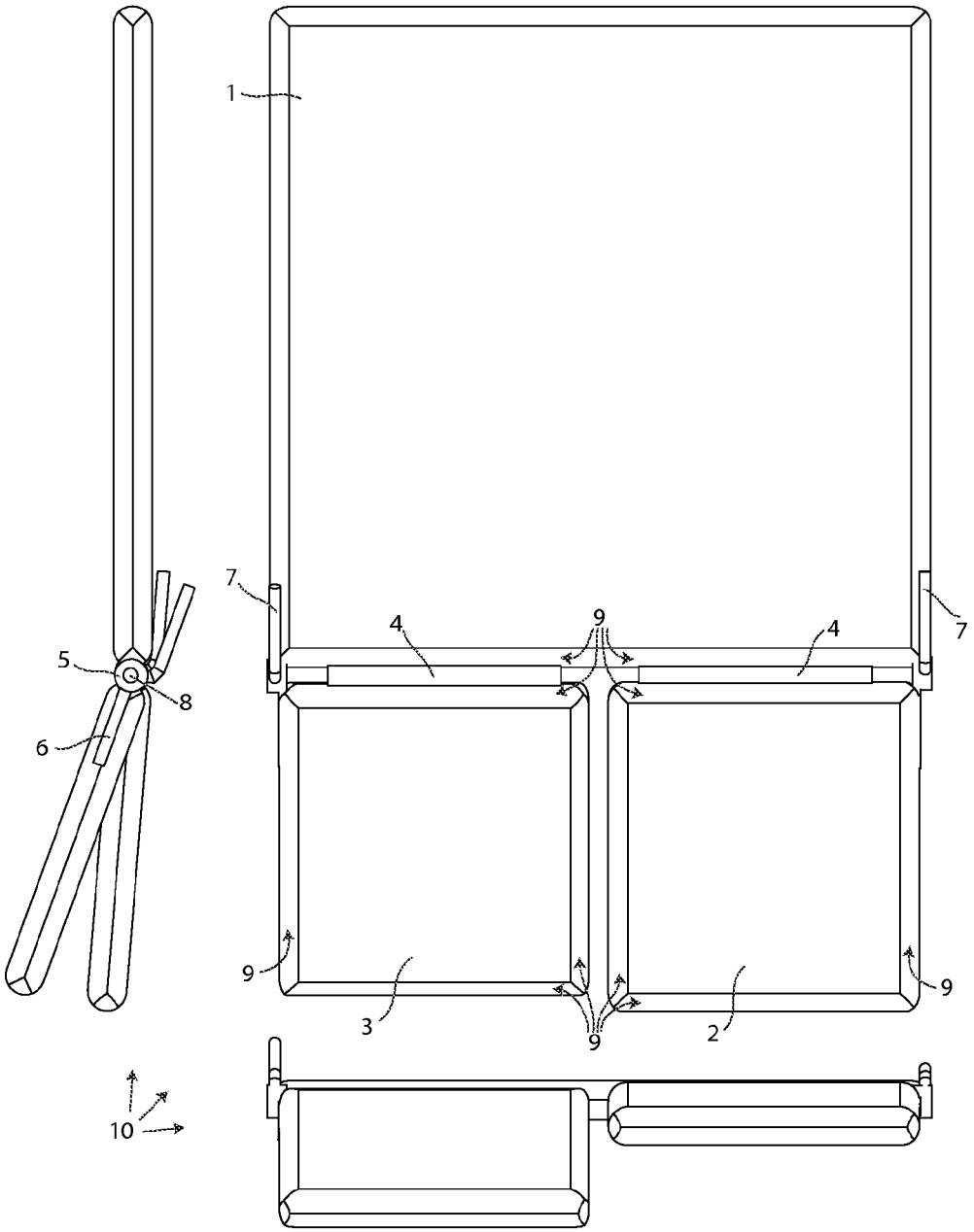
FIG. 10 is a top, side, and front view of an embodiment of the invention in use.

Referring additionally to FIGS. 8, 9 & 10, the dimensions of the partial-leg support are determined by the size of the average intended user, such as adults or children, the width and depth available in most standard seating, such as wheelchairs, office chairs, vehicle seats, etc., safety considerations, and weight and portability considerations. In a preferred embodiment, for average-sized adults, the seat section 1 is approximately 17 to 18 inches square. This size will fit in most wheelchairs and in most other standard seating, while providing a broad base of support. The left extension 2 and right extension 3 are each approximately 8 inches square. The approximate 8-inch width allows for a gap of at least one-half inch between the left and right extensions, to prevent pinching or binding even when the partial-leg support is used in a moving wheelchair or vehicle. The approximate 8-inch length allows for a substantial supporting surface without introducing the balance and stability problems that might result from weight from another source or another person, such as a child, being placed at the end of a longer lever. Also a significantly longer length of the left and right extensions might be cumbersome both when raised and when lowered or dropped toward the floor or toward the wheels and footrests of a wheelchair.

Figure 11:
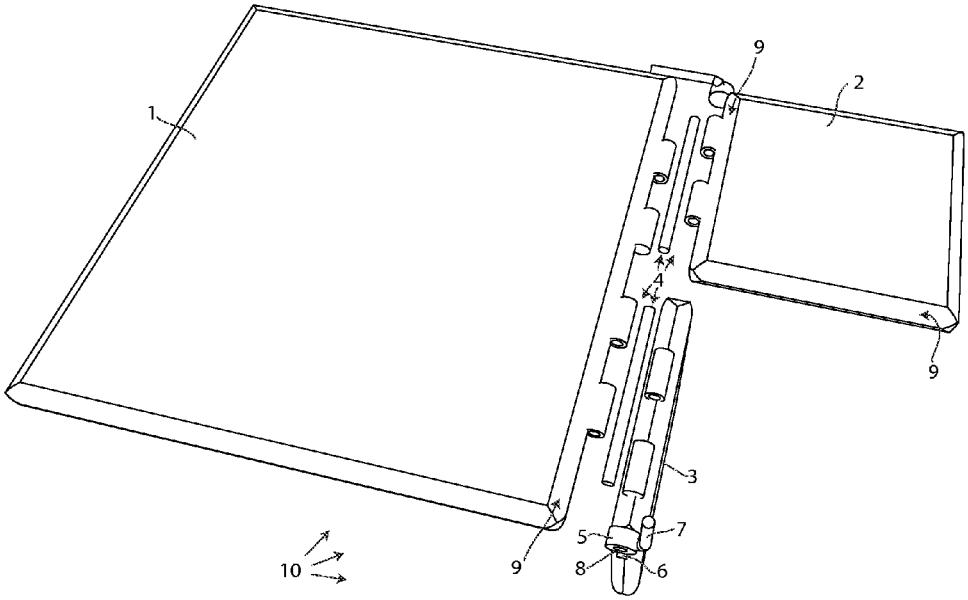
FIG. 11 is a partially exploded view of the hinges of an embodiment of the invention.

Referring to FIG. 11, the hinges 4 can take a variety of forms having the necessary strength and no tendency to pinch. In an embodiment, the hinges are similar to a door hinge, with alternating cylindrical sections and spaces connected by a rod or pin.

The partial-leg support can be made of any material having the appropriate shape-retaining, strength, durability, and tooling properties, or of a combination of such materials. If the partial-leg support is made exclusively of hard or stiff materials, then a separate cushion or pad, such as the washable, changeable ones routinely used by healthcare facilities, can be placed on top of it for the user's comfort. A partial-leg support made primarily of high-density polyethylene (HDPE), obtainable from recycled milk jugs, would be sufficiently durable and light-weight for portability, and could be washed frequently, but not autoclaved for full sterilization, and therefore might be most appropriate for use by one person at home, in the office, or carried around. A partial-leg support made primarily of polypropylene (PP) could be autoclaved, and therefore might be most appropriate for use by a succession of people in a healthcare facility.

Figure 12:
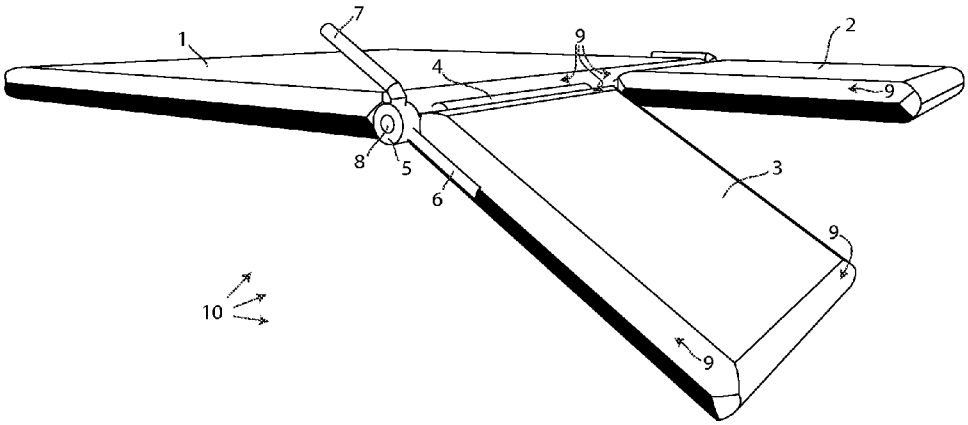
FIG. 12 is a perspective view of an embodiment of the invention made of different layers of material.

Referring to FIG. 12, alternatively the partial-leg support can be made with a cushioning material such as a closed-cell or open-cell foam forming the top surfaces of the seat section 1 and the left and right extensions 2,3, for comfort, and with a more rigid material forming the bottom portions or inner portions, for strength. Many changes and modifications can be made in the present invention without departing from the spirit thereof. I therefore pray that my rights to the present invention be limited only by the scope of the appended claims.

I claim:

1. A partial-leg support for a leg stump or stumps remaining after partial amputation of the leg or legs, while seated, comprising:

a seat section having a top, a top-front edge, and a front edge in relation to a seated person;

a left extension and a right extension, each separately rotatably attached through a hinge to the front edge of said seat section, and having an extension top, an extension back edge meeting the front edge of said seat section, an extension top-back edge, an extension top-front edge, and an extension front edge;

a separate lock-release adapted to control rotation about said hinge for said left extension and said right extension; and a fillet-round void on the top-front edge of said seat section and on the extension top-front and the extension top-back edges of said left extension and said right extension;

where each separate said lock-release prevents or permits rotation about each said hinge attaching said left extension and said right extension, putting top of each said extension into a position of angular relation with top of said section ranging between substantially co-planar with the top of said seat section and a substantially right angle downward;

where said fillet-round voids prevent pinching during rotation about each said hinge and prevent sharp edges at front edges of said seat section and said left and right extensions; and where position of said left and right extensions can be independently adjusted to provide a desired amount of support for a leg stump or stumps while seated.

2. The partial-leg support of claim 1, where said partial-leg support is adapted to be portable and to be used with existing, industry-standard seating.

3. The partial-leg support of claim 1, where said partial-leg support is adapted to be easily cleanable.

4. The partial-leg support of claim 1, where said lock-release further comprises a lock-release button.

5. The partial-leg support of claim 1, where said lock-release further comprises a lock-release handle.

6. The partial-leg support of claim 1, where said lock-release further comprises a lock-release extension lever.

7. The partial-leg support of claim 1, where the axis of rotation of said lock-release is co-axial with axes of rotation of said hinges.

8. The partial-leg support of claim 1, further comprising top surfaces of said seat section and said left and right extensions made of a cushioned material adapted to comfort in sitting, and bottom surfaces of said seat section and said left and right extensions made of a rigid material adapted to stiffness and support.

9. The partial-leg support of claim 1, where said partial-leg support is made from a plastic material selected from the group consisting of high-density polyethylene and polypropylene.

10. The partial-leg support of claim 1, where said partial-leg support is adapted to be easily and thoroughly cleaned so that it can be used by more than one person in succession in a healthcare-facility environment.

11. A method for support for a leg stump or stumps remaining after partial amputation of the leg or legs while seated, comprising:

providing a partial-leg support device, comprising:

a seat section having a top and a seat top front edge in relation to a seated person;

a left extension and a right extension, each separately rotatably attached through a hinge to the front edge of seat section, and having an extension front edge, an extension top, a top-front extension edge and a top-back extension edge meeting the front edge of said seat section;

a separate lock-release adapted to control rotation about said hinge for said left extension and said right extension; and a fillet-round void on the top-front edge of the seat section, on the top-front extension edges, and the top-back extension edges of said left extension and said right extension;

where each separate said lock-release prevents or permits rotation about each said hinge attaching said left extension and said right extension, putting the extension top of each said extension into a position of angular relation with the top of said seat section ranging between substantially co-planar with the top of said seat section and a substantially right angle downward;

where said fillet-round voids prevent pinching during rotation about each said hinge and prevent sharp edges at the front edges of said seat section and said left and right extensions; and where position of said left and right extensions can be independently adjusted to provide a desired amount of support for a leg stump or stumps while seated;

transporting said partial-leg support to a desired location provided with industry-standard seating;

placing said partial-leg support device upon a seat of the industry-standard seating;

raising or lowering said left extension and said right extension into positions providing desired amount of support;

removing said partial leg support device from the industry-standard seating after use; and transporting said partial-leg support device to another location of industry-standard seating.

12. The method for support the leg stump or stumps remaining after partial amputation of the leg or legs while seated of claim 11, where said partial-leg support is adapted to be portable and to be used with existing, industry-standard seating.

13. The method for support for the leg stump or stumps remaining after partial amputation of the leg or legs while seated of claim 11, where said partial-leg support is adapted to be easily cleanable.

14. The method for support for the leg stump or stumps remaining after partial amputation of the leg or legs while seated of claim 11, where said lock-release further comprises a lock-release button.

15. The method for support for the leg stump or stumps remaining after partial amputation of the leg or legs while seated of claim 11, where said lock-release further comprises a lock-release handle.

16. The method for support for the leg stump or stumps remaining after partial amputation of the leg or legs while seated of claim 11, where said lock-release further comprises a lock-release extension lever.

17. The method for support for the leg stump or stumps remaining after partial amputation of the leg or legs while seated of claim 11, where an axis of rotation of said lock-release is co-axial with axes of rotation of said hinges.

18. The method for support for the leg stump or stumps remaining after partial amputation of the leg or legs while seated of claim 11, further comprising top surfaces of said seat section and said left and right extensions made of a cushioned material adapted to comfort in sitting, and bottom surfaces of said seat section and said left and right extensions made of a rigid material adapted to stiffness and support.

19. The method for support for the leg stump or stumps remaining after partial amputation of the leg or legs while seated of claim 11, where said partial-leg support is made from a plastic material selected from the group consisting of high-density polyethylene and polypropylene.

20. The method for support for the leg stump or stumps remaining after partial amputation of the leg or legs while seated of claim 11, where said partial-leg support is adapted to be easily and thoroughly cleaned so that it can be used by more than one person in succession in a healthcare-facility environment.

* * * * *